US011460268B2

(12) United States Patent
Parra

(10) Patent No.: US 11,460,268 B2
(45) Date of Patent: Oct. 4, 2022

(54) MULTI-MISSION FOREGRIP AND QUICK DRAW CARRY SYSTEM FOR LONG-BARRELED FIREARMS

(71) Applicant: Jorge Augusto Parra, Johns Creek, GA (US)

(72) Inventor: Jorge Augusto Parra, Johns Creek, GA (US)

( * ) Notice: Subject to any disclaimer, the term of this patent is extended or adjusted under 35 U.S.C. 154(b) by 0 days.

(21) Appl. No.: 16/155,709

(22) Filed: Oct. 9, 2018

(65) Prior Publication Data

US 2020/0109912 A1 Apr. 9, 2020

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
CPC ..... F41C 23/16; F41C 23/00
See application file for complete search history.

(56) References Cited

U.S. PATENT DOCUMENTS 2,771,697 A * 11/1956 Reising ..... F41C 23/16 42/71.01
7,191,557 B2 * 3/2007 Gablowski ..... F41C 23/16 42/72
7,676,975 B2 3/2010 Phillips
8,429,843 B2 3/2013 Yan
8,438,769 B1 5/2013 Ghannam
8,707,604 B2 4/2014 Troy
9,709,356 B1 7/2017 Anstett
20,170,191 7/2017 Holmes
9,891,020 B2 2/2018 Jen
2005/0241206 A1 * 11/2005 Teetzel ..... F41A 23/08 42/72
2006/0064913 A1 * 3/2006 Gablowski ..... F41C 23/16 42/72
2016/0349004 A1 * 12/2016 Helms ..... F41C 23/22
2017/0159882 A1 6/2017 Moody
2017/0191792 A1 7/2017 Holmes
2019/0390935 A1 * 12/2019 Purkiss ..... F41C 27/00

* cited by examiner

*Primary Examiner* — Steven O Douglas
(74) *Attorney, Agent, or Firm* — Thomas | Horstemeyer, LLP

(57) ABSTRACT

A detachable foregrip for long-barreled firearms with a plurality of ergonomic grip positions, allowing nimble changes of the supporting hand position without changing the position of the device in relation with the firearm or reconfiguring the foregrip; as deemed necessary by the user based on different situational uses or mission or purposes, the user's stance, preferences, unique personal and current physical characteristics; any of the available 9 distinct positions reduces strain and fatigue by means of the proper posture of wrist, elbow and shoulder, and allowing the use of the simplest fatigue relief that is to change the wrist posture without losing weapon control; therefore, improving shooting accuracy, consistency, weapon control, recoil mitigation and endurance; and enables a safe and effective Quick Draw Carry System that improves survivability, deployment, mobility and endurance, and ensures a rested firing hand that always has access to the secondary weapon; ultimately, easing the training path implementing simple and efficient methods.

14 Claims, 10 Drawing Sheets

MULTI-MISSION FOREGRIP AND QUICK DRAW CARRY SYSTEM FOR LONG-BARRELED FIREARMS

DEFINITIONS WITHIN THE SCOPE OF THIS PATENT

Superscript number# is a mark of a definition within the scope of this patent to be found after the section Description of QDCS's Procedures to Carry and Handle Long Barreled Firearms

FIELD

The field relates to grips and, more specifically, to grips for use with firearms and methods for their use. Classification: F41C 23/16, F41C Other classifications: F41C 23/10, F41C 23/14, F41C 23/18, F41C 27/22, F41C 33/08, F41C 33/00

Keywords: foregrip, grip, weapon, forend, fore, fore-end, front, forward, angled, ergonomic

REFERENCES OF CURRENT ART

U.S. Pat. No. 7,191,557, Title: FIREARMS, GRIPS FOR FIREARMS, AND METHODS FOR USING THE SAME, Mar. 20, 2007, Inventor: Gablowski, Jurgen, describes the vertical foregrip type lockable to a fixed point along the firearm rail. It is intended for a single mission.

U.S. Pat. No. 8,429,843 Title: FOREGRIP Apr. 30, 2013, Inventor: Yan; Yuedong, describes a vertical foregrip with quick connect feature to the firearm rail and a retractable option, and it is intended for a single mission.

U.S. Pat. No. 7,676,975 Title: TACTICAL FOREGRIP ASSEMBLY, Mar. 16, 2010, Inventor: Phillips, et al., describes a combination of vertical foregrip with a light and it is intended for a single mission U.S. Pat. No. 8,438,769 B1 Title: WEAPONS FOREGRIP, May 14, 2013, Inventor: Ghannam; Chris S., describes a substantially horizontal molded foregrip matching the contour of the hand, similar fashion as the US Patent Application: 20170191792. Because of its nature, it is a non-ambidextrous accessory and it is intended for a single mission. This type of grip because of its nature negates the opportunity to transition from one shoulder to the other shoulder and leaving an awkward hand posture.

U.S. Pat. No. 8,707,604, Title: ANGLED BIPOD FOREGRIP FOR FIREARM, Apr. 29, 2014, Inventor: Troy; Stephen P., describes a combination of an angled foregrip with a bipod, extending down and outwards legs to configure a bipod mode. As an angled foregrip it is intended for a single mission.

U.S. Pat. No. 9,611,977 Title: VERTICAL FORE GRIP WITH BIPOD, Apr. 4, 2017, Inventor: Moody; Joseph R., describes a vertical foregrip containing a pair of telescopic legs that if deployed will configure a bipod. In the foregrip mode, it would be intended to support only one weapon's mission.

U.S. Pat. No. 9,709,356 Title: MULTI-AXIS FIREARM FOREGRIP, Jul. 18, 2017, Inventor: Anstett; Todd J., describes an articulated foregrip looking for a more ergonomic hand posture based on a lockable rotating sphere; it would be intended to support only one weapon's mission.

U.S. Pat. No. 9,891,020 B2, Title: MULTI-PLATFORM ERGONOMIC FOREGRIP, Feb. 13, 2018, Inventor: Yi Huei Jen, discusses the advantages of an angled foregrip against a vertical foregrip, illustrates the concept of firearm control hand techniques, the use of handguard guide stops, and the M-LOK most popular modular handrail systems. This grip would provide a very short tool extension, replicating one of the positions 1P, 2P and 3P supporting directly the handrail and adding handguard guide stops; it would be intended to support only one weapon's mission.

US Patent Application: 20170191792, Inventor: Holmes, Patent Title: AXIALLY OFFSET FOREGRIP FOR A FIREARM AND RELATED DEVICES, SYSTEMS, AND METHODS, provides a tool extension that addresses the Shoulder Horizontal Adduction angle and would reduce this typical 10° degree angle (Max. 60° degrees) for one of the positions 1P, 2P or 3P. This type of grip because of its nature is a non-ambidextrous accessory, it would compromise carrying the weapon with an asymmetrical protuberance, and as the current art, it would be intended to support only one weapon's mission. This type of grip because of its nature negates the opportunity to transition from one shoulder to the other shoulder.

BACKGROUND OF THE INVENTION

A foregrip is a firearm accessory attached to a handguard, usually located towards the front end of a long-barreled firearm to provide a stable foundation for weapon control[1], shooting accuracy and recoil mitigation[2], and to improve consistency and endurance.

Many speed and CQC[3] shooters prefer to support the rifle at shoulder height holding the handguard directly compromising consistency by not placing their hand on the same location; however, to render effective weapon control and recoil mitigation, they have to expend extra energy holding and applying force very close to the handguard axis using only friction (inline grip). Using this method user quickly fatigues due to a very awkward posture with low bearing capacity and so close to the barrel axis. In any case, they discard the benefit of a foregrip to isolate the hand from the heated handguard making the firearm easier to handle as it generates large amounts of heat during firing.

Regardless user's strength, weapon's weight, type, shape and caliber, and handguard's shape and size, the handguard inline grip awkward posture poses high biomechanical stresses to the involved joints, ligaments, tendons and tissues, therefore wrist, elbow and shoulder muscles quickly fatigue due to the merge of large:

- Elbow Extension: Straightened arm, see FIG. 5A
- Shoulder Flexion: Raised arm straight to the front, see FIG. 5B
- Shoulder Horizontal Adduction: Bent arm horizontally passing the center of the head (Pass the Sagittal Plane that divides right and left sides of the body), see FIG. 5C
- Elbow Supination: Rotated elbow along arm's axis into an elbow up position, see FIG. 5D
- Wrist Supination: Rotated wrist along the forearm axis into a palm up position (as scooping the soup), see FIG. 5D
- Wrist Extension: Bent wrist towards the back of the hand, see FIG. 5E
- Wrist Ulnar Flexion (ulnar deviation): Bent wrist to the side of the little finger (ulnar bone)
  - All Vertical Foregrips render awkward Radial Flexion (opposing Ulnar Flexion), see FIG. 5F The ergonomic functionality would bring shooters the ability to use the proper posture of their support hand, especially for long periods of time, reducing the wrist, elbow and shoulder strain that results in fatigue, muscle vibration, shaking and eventual pain associated with the use of a horizontal handguard or vertical foregrip, mostly used as a handguard guide stop. Therefore, many shooters have the preference to use an angled foregrip looking for a more neutral wrist, elbow, and shoulder posture for long-term weapon control, shooting accuracy, recoil mitigation, and consistency, and the best mission result. In addition to its ergonomic functionality, an angled foregrip would allow shooters to employ different firearm control hand techniques with palm, thumb and index finger to reduce energy consumption, or potentially nimbler, more natural, instinctive, controllable, comfortable or robust, or simply to access or avoid other attached devices. However, shooters cannot use the simplest fatigue relief that is to change the angles of the wrist without losing weapon control.

In yet another aspect of the art, the bracing distance defined as the distance between the support hand holding the weapon's front-end and the buttstock's heel sat on the user's shoulder pocket. Basically, the firearm is braced to the torso (making up a triangle from shoulder to shoulder, extension of the support arm and bracing distances) and firearm's weight is distributed between the user's support hand and shoulder. The bracing distance creates a compromise between the extreme weapon control of a large bracing distance with a lighter load reaction on the support hand with torso rotation for CQC, even though a larger body's moment of inertia with extended arm increases torso and legs energy consumption; and the stability of a small bracing distance (elbow closer to the body) with static torso and steady weapon for accurate long distance shooting, even though having support hand closer to the firearm's center of gravity renders heavier supported weight reaction; and an intermediate bracing distance for everything else. This compromise is exacerbated by the continuously changing circumstances in modern combat and highly mobile shooting games where milliseconds count.

Currently, shooters are limited to use a vertical, single slope or articulated foregrips then they have to settle adapting their support hand to one mission with a fixed single geometry and bracing position along the handguard; or, consume critical time under high stress and risk adjusting foregrip's geometry, in any case, forcing the hand to remain in the same position, therefore, any other optimal use of the weapon is compromised.

Moreover, shooters are required to add other accessories to the weapon to add aiming stability:

1. Supporting the weapon pushing forward against a barricade using barricade supports or stops.
2. Over the floor or any other suitable surface using monopods or bipods.

However, this is achieved by adding weight to the firearm's worst place. In general, it is recommended to minimize the weight of the weapon, especially to avoid attaching heavy accessories close to the front end of the weapon since weapon's moment of inertia will increase (equivalent to mass in rotational movements), therefore, increasing energy consumption for weapon control and slowing it down.

In yet another aspect of the art, shooters use an over the shoulder or across the chest long sling to carry their weapon over long distances or for mobility[4]; as the target approaches the weapon is handled over one of the ready positions and finally mounted to start aiming; and if needed, under high stress and risk, transferred to the other shoulder, expend critical time getting in and out of aiming aids such as the bicep cuff or the hasty sling, adjusting the sling length or fishing to grab the rifle; all of this using quite awkward, inefficient, limiting and cumbersome procedures that must be mastered. To alleviate this aspect, numerous carry styles, sling configurations, designs, and procedures have been created considering some of the following factors:

- Safety, survivability
- Muzzle awareness[8], flagging, and protection from water and debris
- Deployment (response time), aid for aiming and shot follow up, lose sight of the target
- Firearm access, retention, stowing, release, stability, mounting, transition to the other shoulder, reloads and feeding stoppage remediation
- Ergometry, motions and energy economy, manipulation, ambidexterity
- Interferences, visual and physical, firearm mechanisms and controls, secondary weapon access
- Mobility
- Weather, garments, gloves, chest gear
- Mission dependency
- Sling complexity, removability, adjustability, hardware, installation, 1PS (1 Point Sling), 2PS, 3PS, stretchability, noise, dimensions, materials, cost, padding, and comfort.
- Style: American, European, African, Russian, across the back, backpack, Hasty Sling, Bicep Cuff Hanging a firearm with a strap seems a very elemental issue, however improving the art addressing all factors, just mentioned, has proven to be a major challenge.

Lastly, it is common knowledge that firearms are used under the most extreme and rigorous conditions, therefore, the firearm and its accessories must be simple, robust, capable, reliable and easy to operate under all conditions the firearm is used; ideally, with reduced training and maintenance.

SUMMARY OF INVENTION

The enhanced foregrip subject of this patent offers 9 distinct ergonomic plus 4 improved conventional grip positions and 35 firearm control hand techniques to facilitate optimal fitting of the firearm to the user based on the different situational uses or missions, and the users' body makeup, stance, preferences, and their current physical characteristics; being reliable and simple, since its optimum use is reduced to change hand position and taking advantage of the simplest fatigue relief that is to change the angles of the wrist without losing weapon control[1]. Independently from the mission, the ergonomic multiple support hand grip positions offer a more neutral wrist, elbow and shoulder posture that would maximize control and force production potential of the joints muscles, at the end rendering faster response and wider movement range for a longer time. In addition, the foregrip can be used as a barricade stop or rested on a surface as a monopod.

Even more, the foregrip subject of this patent integrates a single effective multi-mission Quick Draw Carry System (QDCS) that improves safety, deployment, mobility[4], endurance, mounting, shoulder transitions, reload and feeding stoppage remediation, furthermore, provides unobstructed access to the secondary gun at any time during the mission and reduces interferences and training.

Therefore, the foregrip and the QDCS subject of this patent would improve safety, survivability, shooting accuracy, consistency, weapon control and recoil mitigation by means of a well-positioned support hand and a fully available rested firing hand for the best trigger control possible for both the primary and the secondary weapons and very simplified training. Certainly, the enhanced foregrip subject of this patent would be an innovative tactical advantage for civilian, law enforcement, military, recreational and professional users.

Lastly, the foregrip subject of this patent does not add excessive weight to the front end of the weapon, doesn't use time-consuming adjusting procedures under high stress and risk, doesn't need to use tools, and doesn't add mechanisms or parts prone to failure.

DETAILED DESCRIPTION OF THE INVENTION

The detailed description of the Invention will be divided in the following sections:

Foregrip Description
Detailed Grip positions
Detailed Ergonomic Aspect
Other Aiming Aids
Quick Draw Carry System (QDCS)
Detailed QDCS component description
QDCS Procedures to carry and handle long barreled firearms
Quick Draw Carry System improvements over current art

Foregrip Description

The foregrip described herein is a unitary body comprising a bi-dimensional closed loop layout created with smoothly connected curved profiles, with dimensions to match various sizes of hands, comprised by the following zones outlining the external surfaces of the foregrip: (Refer to FIG. 1)

- The front-end zone (1Z) closest to the muzzle of the weapon
- The rear end (3Z/4Z) closest to the trigger of the firearm, comprised of two useful zones: The rear upper zone (3Z) and the rear lower zone (4Z) resembling a typical pistol grip
- The bridge zone (2Z) connecting both ends together, it is much longer than the previous ones and exposes the handguard with an opening relief growing towards the weapon's rear end and provides a smoother slope angled grip The front-end zone (1Z) comprises 3 useful profiles: 1. Top horizontal flat (1H) representing a flat surface used to attach the foregrip to the handguard, 2. Front rounded (1F) has a very steep slope angle ending vertically, and 3. Rear rounded (2F) a curve close to 90 degrees. The rear upper zone (3Z) comprises five (5) profiles 1. A top horizontal flat (2H) representing a flat surface used to attach the foregrip to the handguard, 2. A front rounded (1U) sloped with a steep angle, 3. A rounded smooth sloped profile (2U), 4. A steep angle profile (4U) to create the wider sloped bridge relief, and 5. A back curve sloped slightly forward (3U). The rear lower zone (4Z) like a pistol grip with four (4) profiles: 1. A front distal profile (1L), 2. The back proximal profile (2L), 3. A recessed rounded profile (4L), and 4. A bottom horizontal flat profile (3L) representing a flat surface. The bridge zone (2Z) is comprised of four (4) rounded profiles: 1. A lower rounded profile (3F) close to the front end, 2. A lower rounded profile (3B) close to the rear end, and 3. A lower rounded profile (1B) to the middle, and 4. The upper smooth slope profile of the bridge (2B). The foregrip is a 3D solid body; its external surface is created connecting several cross sections where front end, rear upper end, rear lower end, and the bridge has a plurality of at least substantially oval cross-sections with their major axis or minor axis extending between their own profiles previously described. The surfaces that generate the lofted 3D solid object have a typical section of two offset ellipses to create a shelled body with multiple ergonomic grips. The foregrip is comprised of two symmetrical halves attached together making it an ambidextrous accessory.

Figure 4A:
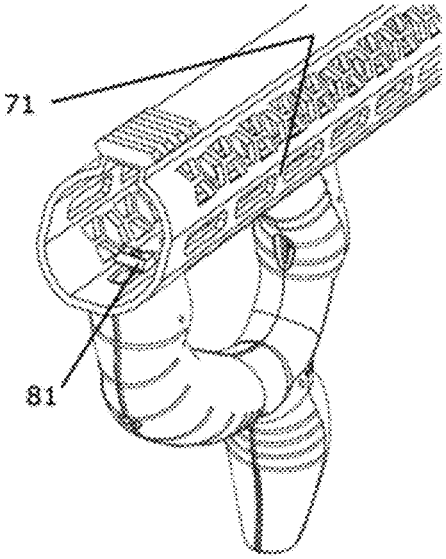
FIG. 4A: M-LOK Handguard platform version of foregrip subject of this patent. Barrel is omitted for clarity.
Figure 4B:
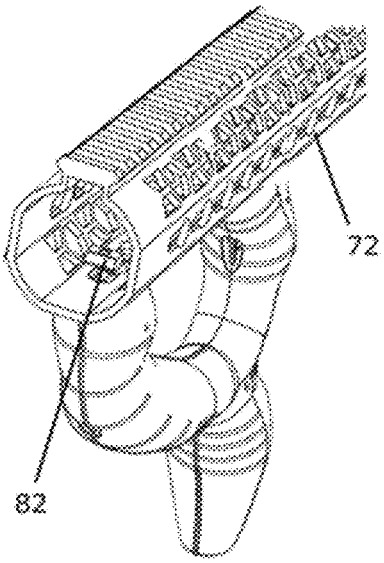
FIG. 4B: KEYMOD handguard platform version of foregrip subject of this patent. Barrel is omitted for clarity.

The foregrip described, herein, can be mounted directly on M-LOK (see FIG. 4A) as well as on KeyMod (see FIG. 4B) modular handguard platforms maintaining strength and stability over the proven M-LOK and KeyMod handguard designs. Also, it can be installed on MIL-STD-1913 Picatinny rails using a commercial adaptor.

Figure 4C:
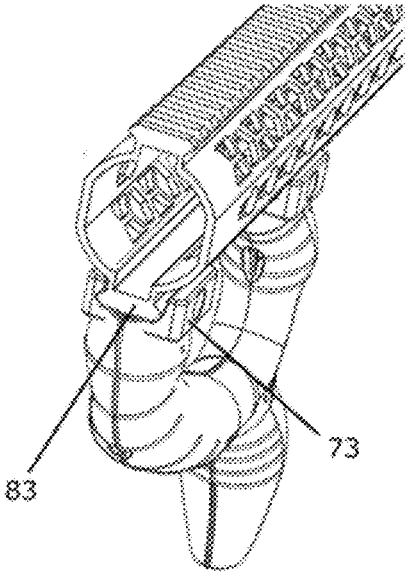
FIG. 4C: Picatinny rail platform version of foregrip subject of this patent. Barrel is omitted for clarity.

A secondary version with built-in clamps in the front end and the rear end comprising a profile matching the MIL-STD-1913 Picatinny rail platform (see FIG. 4C) allows direct attachment to this type of rails. Using a rail adaptor this version can be installed in either modular handguard described in the previous paragraph.

The foregrip material can be a high strength polymer, composite or a lightweight alloy. The surface finish of the foregrip is knurled or texturized or may be of a tactile polymeric material, such as an over-molded rubberized grip to improve gripping, reduce slipping and incorporate tactile marks for consistency. In manufacture, the foregrip can be made by any suitable method, including but not limited to injection molding, 3D printing, stamping, forging, casting, machining, welding, and soldering. The foregrip two symmetrical halves can be attached together by mechanical fasteners or bonded together by chemical or thermal means.

Detailed Grip Positions

The foregrip, configured as described herein, enables in one single unit the utilization of the handguard or angled fore-end grips with slopes ranging from smooth to very steep and with bracing distances resulting from fully extended arm to elbow very close to the body, providing the following thirteen (13) distinct support hand grip positions for a total of (35) hand techniques gathered in following three (3) groups: (refer to FIGS. 1 and 2)

Group 1—For those who prefer supporting the firearm with the hand against the handguard, the foregrip described herein does not inhibit this practice, on the contrary, it provides guide stops for consistency: 3 positions, 12 techniques.

(1P) Towards the muzzle after the foregrip using surface (1F) as a guide: a) With the palm of the hand facing up with the thumb over the handrail. b) Thumb pointing forward. c) Palm facing down with thumb below handguard. d) Vertical palm and thumb over the handguard (Costa's rifle grip). This position is possible if the distance from the front end of the handguard to the front of the foregrip is at least the width of the palm. For four (4) techniques.

(2P) In between front and rear ends of the foregrip using surface (2F) as a guide: a) With the palm of the hand facing up with the thumb over the handrail. b) Thumb pointing forward. c) Palm facing down with thumb below handguard. d) Vertical palm and thumb over the handguard (Costa's rifle grip). For four (4) techniques.

(3P) Rearward before the foregrip using surface (3U) as a guide: a) With the palm of the hand facing up with thumb wrapping handrail. b) Thumb pointing forward. c) Palm facing down with thumb below handguard. d) Vertical palm and thumb over the handguard (Costa's rifle grip). This position is possible if the distance from the rear end of foregrip to the magwell or trigger guard is at least the width of the palm. For four (4) techniques.

To support all previous three positions the handrail should have a length of at least 12.3". Notice that AK, G3 or FAL type weapons require extra handguard space in the rear for magazine installation and removal. With a Picatinny Rail or Handrail Extension, it could be installed in TAVOR, GALIL and similar platforms with short handrails.

Group 2—Support hand on ergonomic sloped grip: 9 positions, 22 techniques.

(4P) Forward very steep slope angle grip with: a) Half palm on (1F) and thumb wrapping over the handrail. b) Half palm on (1F) and thumb pointing forward. c) Palm against the surface (1F) and thumb wrapping around surface (2F). d) Palm against the surface (1F) and thumb pointing forward. For four (4) techniques.

(5P) Forward steep slope angle grip for hand palm against the bridge surface (3F) with: a) Thumb wrapping around surface (2B). b) With thumb pointing forward. For two (2) techniques.

(6P) Forward smooth slope angle grip for hand palm against bridge surface (1B) with: a) Index finger sitting high against the surface (1F) and thumb sitting against the surface (2F). b) Thumb wrapping around surface (2B). c) Thumb pointing forward. For three (3) techniques.

(7P) Intermediate steep slope angle for hand palm against the rear upper surface (1U) with a) Thumb pointing forward. b) Thumb wrapping over the handrail. For two (2) techniques.

(8P) Intermediate smooth slope angle on the surface (3B) with: a) Thumb pointing forward. b) Thumb over the surface (4U). For two (2) techniques.

(9P) Intermediate smooth slope angle on surfaces (3B) and (1L) with: a) Thumb pointing forward. b) Thumb over the surface (4U). For two (2) techniques.

(10P) Rearward smooth steep slope angle grip against rear upper surfaces (2U) and (4U) with a) Thumb pointing forward. b) Thumb wrapping handrail. For two (2) techniques.

(11P) Rearward steep slope angle grip with palm against the rear upper surface (3U) with a) Index finger wrapping (1U) rest of the fingers wrapping (4U). b) Three fingers wrapping (4U) and index finger pointing forward. For two (2) techniques.

(12P) Rearward Steep slope angle grip with hand palm against the surface (1L): a) Thumb wrapping surface (4L) for a typical pistol grip with four fingers wrapping surface (1L). b) Index finger pointing forward (three fingers grip). c) Index finger over the surface (4U). For three (3) techniques.

Group 3—Other support arrangements: One position, one technique:

(13P) Improved Olympic shooting stance supports the bottom of the foregrip surface (3L) with weak side fingers (and magazine on palm) or palm and elbow against the hip, rotated out towards the same side and up.

For all missions and carrying, the foregrip described herein provides shooters an ample set of options to locate the supporting hand optimized for all missions and carrying the firearm and to reduce fatigue and improve the mission result: (Refer to FIGS. 1 and 2) [Grip Position (Techniques Available)]

A. Long distance accurate shooting, looking for high stability: 3P (4), 10P (2), 11P (2), 12P 3), 13P (1)

B. Short distances shooting as in CQC: 1P (4), 4P (4), 5P (2), 6P (3)

C. General purpose intermediate distances: 2P (4), 7P (2), 8P (2), 9P (2)

Figure 7B:
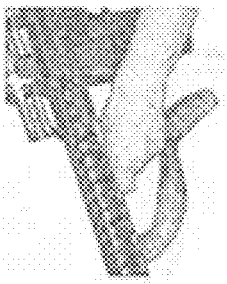
FIG. 7C: Rifle Carry using Rear Upper of Multi-Mission Foregrip
FIG. 7D: Rifle Carry using Front End of Multi-Mission Foregrip
FIG. 7E: Rifle Carry using Bridge Front End of Multi-Mission Foregrip
FIG. 7F: Rifle Carry using Bridge Rear end of Multi-Mission foregrip
Figure 7D:
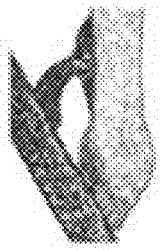
Figure 7A:
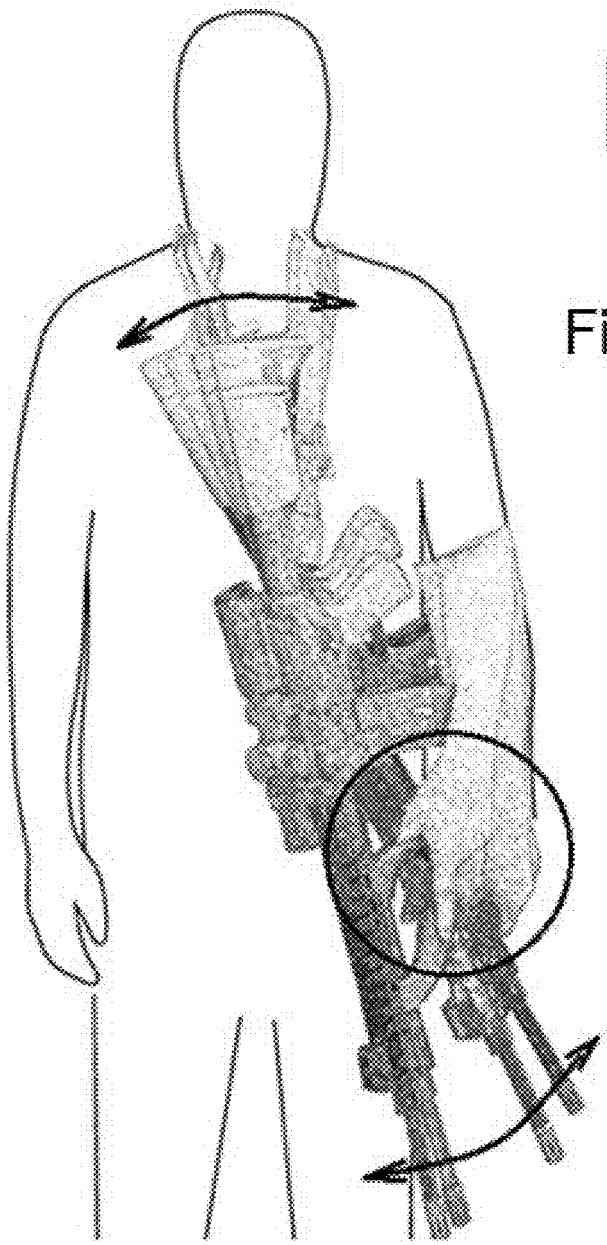
Figure 7E:
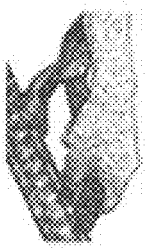
Figure 7C:
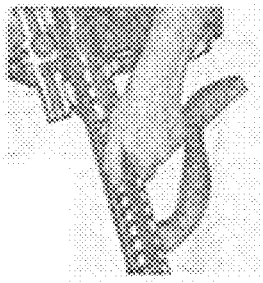
Figure 7F:
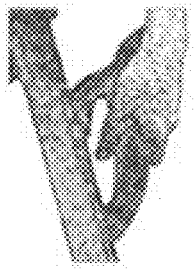
Figures 8A, 8B, 8C, 8D:
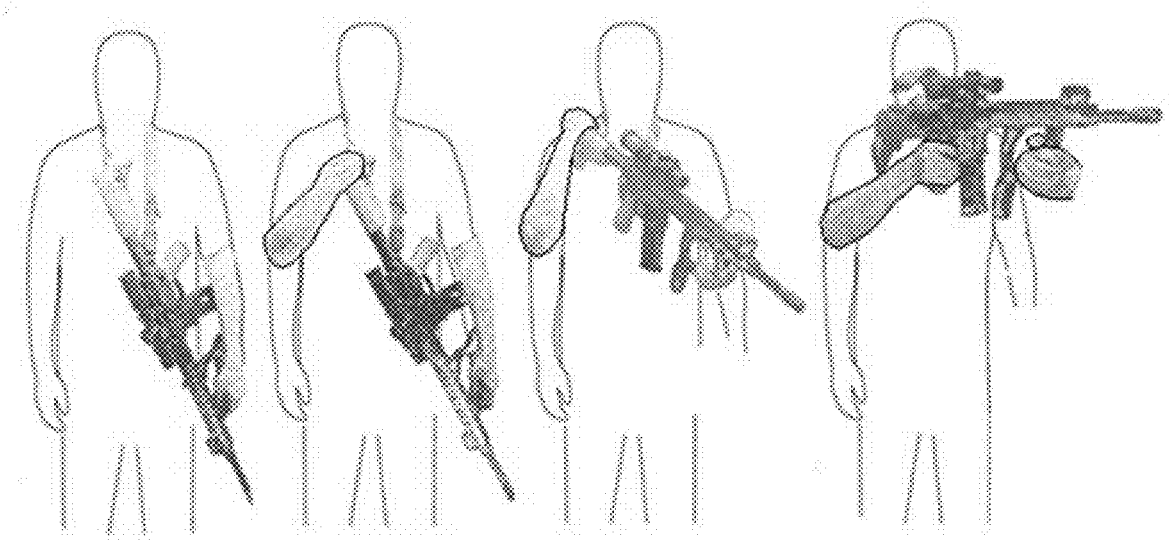
FIG. 8A: Quick Draw Carry System rifle mounting and unmounting sequence. Start position on the left
FIG. 8B: Second action Grasp Buttstock. This is the alert position
FIG. 8C: Third action simultaneous shoulder or arm abduction with a forearm or elbow flexion and raise rifle and shoulder the weapon
FIG. 8D: Last position grip weapon and start sight alignment

D. Fine tune the Quick Draw Carry System using a neutral support hand posture and a short sling around the neck with free strong hand: 4P (only b and c, see FIG. 7D.), 5P (2, see FIG. 7E), 6P (3, see FIG. 7F), 8P (2), 9P (2), 10P (only a, see FIG. 7C), 11P (3, see FIG. 7B), 12P (2, see FIG. 7A).

The foregrip allows to simultaneously apply enough force to the foregrip sitting the weapon against the user's shoulder or pushing forward to stabilize firearms without buttstock along a line 3.5"-6.5" below and offset of the bore axis, to effectively withstand the recoil and muzzle raise momentums to mitigate recoil, and would allow dedicating the rested and relaxed strong hand to trigger control. See Table 1.

Detailed Ergonomic Aspect

Traditionally, to be able to aim effectively, speed and CQC rifle shooters must use the weak hand, with the fully extended arm, to support the rifle's fore-end at shoulder level and very close to the handguard axis using only friction (inline grip). This is an awkward posture with a low bearing capacity, shooters must expend extra energy and quickly fatigue, the muscle starts vibrating, shaking, and hurting; rendering at the end ineffective weapon control and recoil mitigation, and shooting accuracy is degraded.

The compromised joints are the support hand wrist, elbow, and shoulder.

A neutral (ideal) posture of a joint is achieved when:

The joint muscles are at their resting length and the joint is naturally aligned. When a joint is not in its neutral posture, its muscles and tendons are either contracted or elongated For most joints, the neutral posture is associated with the midrange of motion for that joint Joints in neutral postures have a maximum capability of force production, control, and damping Neutral postures also minimize energy consumption and stress of the muscles, tendons, nerves, ligaments, and bones A posture is considered "awkward" when it moves away from the neutral posture towards the limits of the range of motion. Why should an awkward posture be avoided?

Figure 1:
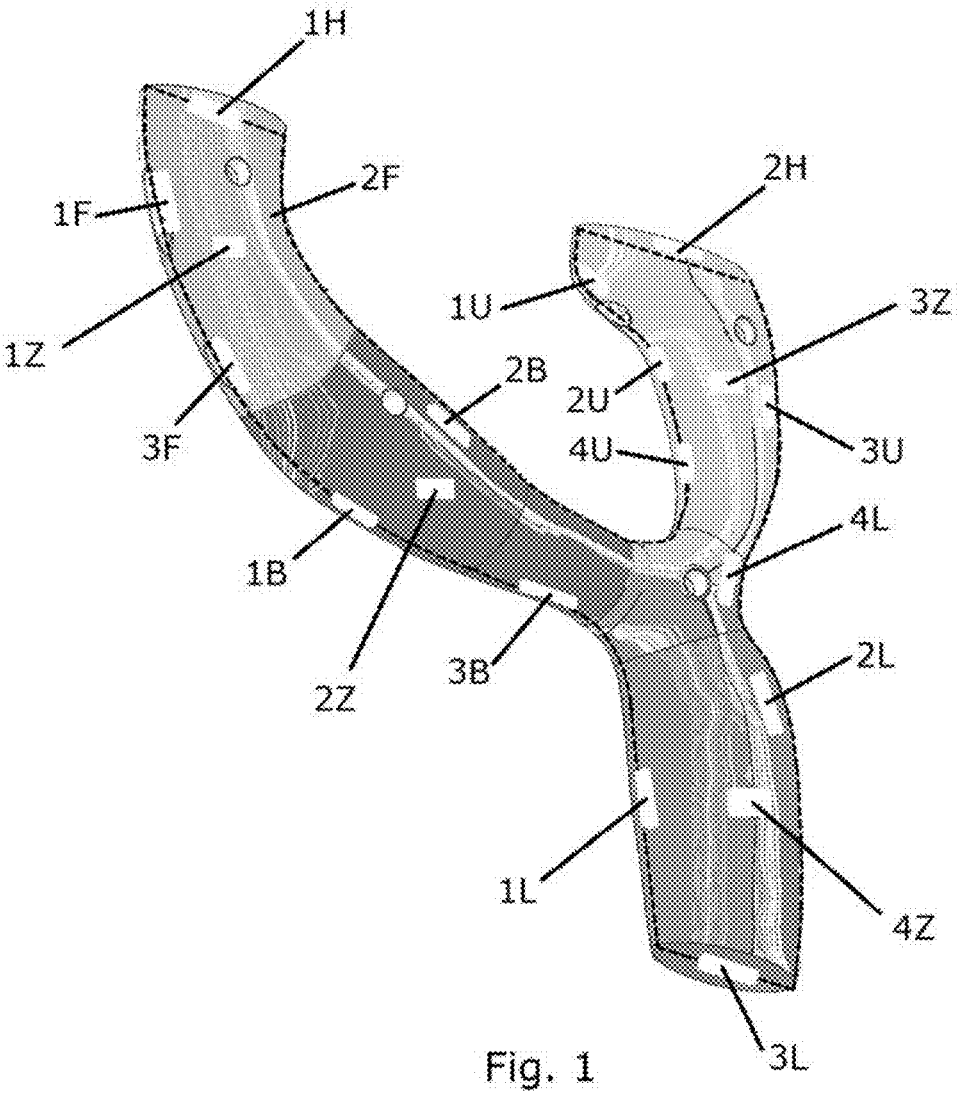
FIG. 1: Multi-Position foregrip zones and profile (or surface) identifiers
Figure 2:
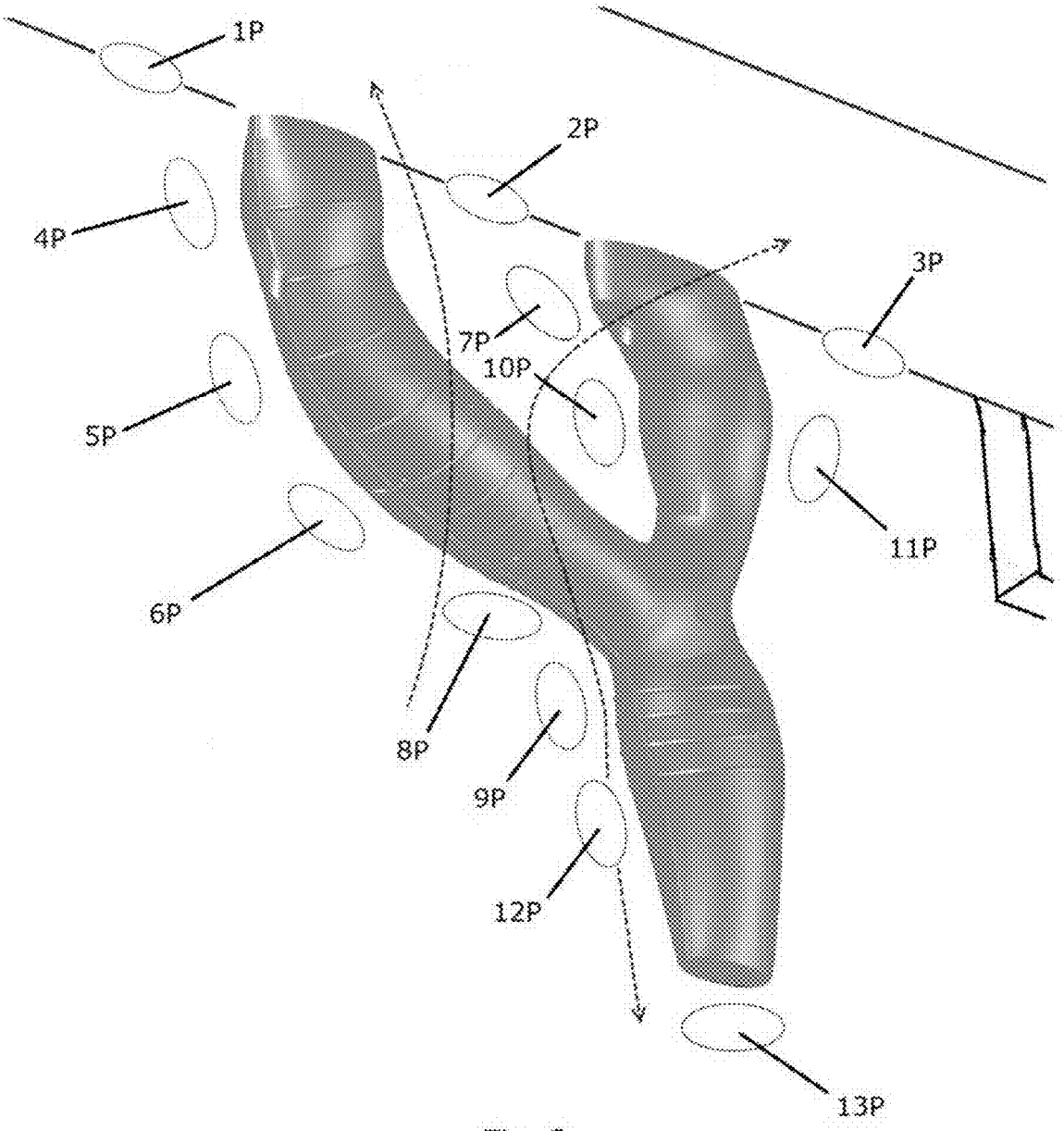
FIG. 2: Multi-Position Foregrip grip identifier, positions, and missions

In a joint awkward posture, muscle force, damping, and control potential is greatly reduced In awkward postures, muscles must work harder and expend more energy doing the same job Working in extreme awkward postures causes high stress on muscles, tendons, ligaments, joints, and bones Also, sooner muscles start vibrating, shaking, hurting and compromising work stability Fatigue occurs sooner and the risk of injury increases The foregrip subject of this patent provides 9 nine distinct support hand grip positions (Theoretically, they can't be counted) that reduce the awkward posture of elbow, shoulder and wrist joints that result of holding a rifle at shoulder height (Mount Position or Weapon deployed) as follows, see Table 1 and FIG. 1:

Reducing Elbow Extension: Providing a tool extension, arm bent from 0° degrees up to an angle between 35° degrees-85° degrees, FIG. 5A Reducing Shoulder Flexion: Providing a tool extension, lowering arm from 90° degrees down to an angle between 40° degrees-75° degrees, FIG. 5B Shoulder Horizontal Adduction must remain: Bent arm horizontally passing the center of the head 10° degrees (Max. 60° degrees), FIG. 5C Reducing Elbow Supination: Providing a wide palm angled support, elbow rotated along arm's axis into a palm up angle from 45° degrees down to no supination 0° degrees, FIG. 5D Reducing Wrist Supination: Providing a wide palm angled support, rotated wrist along the forearm axis into a palm up position palm from 80° degrees down to no supination 0° degrees up to 20° degrees, FIG. 5D Reducing Wrist Extension: Providing a wide palm angled support, extended wrist from 60° degrees down to no extension 0° degrees up to 15° degrees towards the back of the hand, FIG. 5E Reducing Wrist Ulnar flexion (ulnar deviation): Providing a wide palm angled support, rotated wrist from 30° degrees down to no ulnar flexion 0° degrees up to 10° degrees towards the little finger (ulnar bone) side, FIG. 5F Shooters should find their preferred set of foregrip positions, factoring their body makeup, stance, current gear, and main mission, to achieve the most neutral posture wrist, elbow and shoulder (halfway of the articulation range of motion) reducing muscle strain, fatigue, vibration and shaking, and maximizing control and force production potential of the joints muscles; therefore, obtaining faster response and wider weapon control range, and improving shooting accuracy, consistency, endurance and mission results; this is a very innovative tactical advantage.

TABLE 1

Figure 5A:
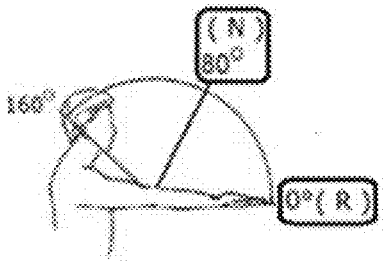
FIG. 5A: Elbow joint range of Flexion, from N (Neutral) towards 160 deg and Extension from N (Neutral) towards 0 deg. [R]=0 deg. typical Rifle Mount awkward posture
Figure 5B:
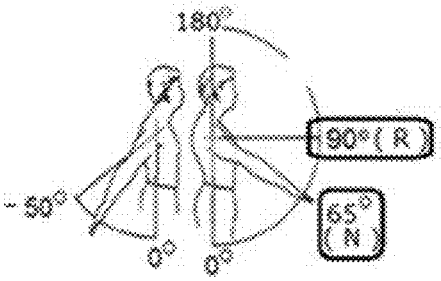
FIG. 5B: Shoulder joint range of motion of Flexion from N (Neutral) to 180 deg and Extension from N (Neutral) to −50 deg. [R]=90 deg. typical Rifle Mount awkward posture
Figure 5C:
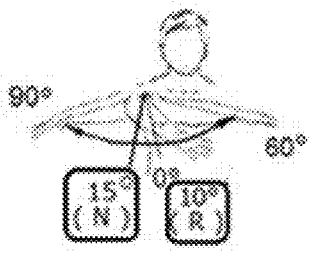
FIG. 5C: Shoulder joint range of motion of Horizontal Abduction away from chest towards 90 deg and Adduction over chest towards 60 deg. [R]=10 deg, typical Rifle Mount is not considered awkward posture
Figure 5D:
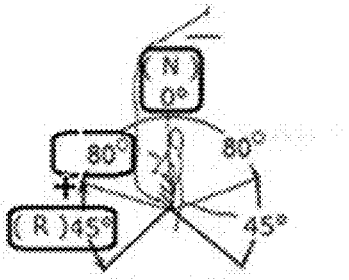
FIG. 5D: Elbow and Wrist joints range of motion of Pronation: thumb in, and Supination: thumb away (Soup) that is wrist rotated along the forearm axis into a palm up position. [R]=80+45=135 deg, typical Rifle Mount awkward posture
Figure 5E:
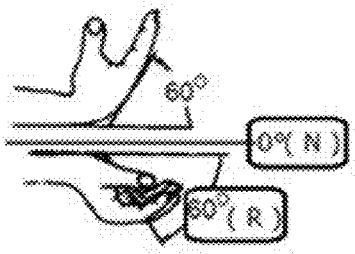
FIG. 5E: Wrist joint range of motion of Flexion: wrist rotates in and Extension: wrist rotates away. [R]=60 deg, typical Rifle Mount awkward posture
Figure 5F:
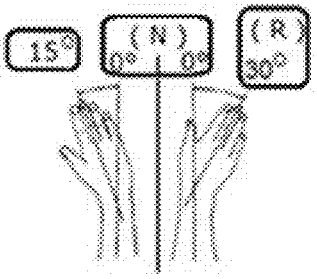
FIG. 5F: Wrist joint range of motion of Radial: Wrist rotates away ulnar bone and Ulnar deviations: Wrist rotates towards ulnar bone. [R]=30 deg, typical Rifle Mount awkward posture. Vertical Foregrips render 15 deg. Awkward Radial deviation

| GRIP POSITION | MISSION | ELBOW EXTENSION ANGLE FIG. 5A | SHOULDER FLEXION ANGLE FIG. 5B | SHOULDER HORIZONTAL ADDUCTION ANGLE FIG. 5C | ELBOW SUPI-NATION ANGLE FIG. 5D | WRIST SUPI-NATION ANGLE FIG. 5D | WRIST EXTEN-SION ANGLE FIG. 5E | WRIST ULNAR FLEXION ANGLE FIG. 5F | SUPPORT HAND WEIGHT REACTION % | BORE AXIS OFFSET Inches |
|---|---|---|---|---|---|---|---|---|---|---|
| 1P* | CQC | 0°* | 90°* | 10° | 45°* | 80°* | 60°* | 30°* | 48% | 0 |
| 4P | CQC | 35° | 75° | 10° | 0° | 0° | 0° | 5° | 52% | 3.5 |
| 5P | CQC | 45° | 70° | 10° | 0° | 15° | 0° | 0° | 55% | 4 |
| 2P* | MID-RANGE | 45° | 70° | 10° | 40°* | 65°* | 60°* | 28°* | 55% | 0 |

TABLE 1-continued

| GRIP POSITION | MISSION | ELBOW EXTENSION ANGLE FIG. 5A | SHOULDER FLEXION ANGLE FIG. 5B | SHOULDER HORIZONTAL ADDUCTION ANGLE FIG. 5C | ELBOW SUPI-NATION ANGLE FIG. 5D | WRIST SUPI-NATION ANGLE FIG. 5D | WRIST EXTEN-SION ANGLE FIG. 5E | WRIST ULNAR FLEXION ANGLE FIG. 5F | SUPPORT HAND WEIGHT REACTION % | BORE AXIS OFFSET Inches |
|---|---|---|---|---|---|---|---|---|---|---|
| 6P | CQC | 50° | 60° | 10° | 0° | 20° | 0° | 0° | 60% | 5 |
| 7P | MID-RANGE | 60° | 70° | 10° | 0° | 15° | 15° | 5° | 61% | 3 |
| 8P | MID-RANGE | 60° | 50° | 10° | 0° | 15° | 0° | 5° | 60% | 5 |
| 9P | MID-RANGE | 60° | 45° | 10° | 0° | 5° | 0° | 5° | 64% | 5.5 |
| 10P | LONG | 70° | 45° | 10° | 0° | 5° | 10° | 10° | 67% | 3.5 |
| 11P | LONG | 80° | 60° | 10° | 0° | 5° | 15° | 0° | 69% | 3.5 |
| 12P | LONG | 85° | 40° | 10° | 0° | 5° | 0° | 0° | 67% | 6.5 |
| 3P* | LONG | 90° | 55° | 10° | 35°* | 60°* | 60°* | 25°* | 72% | 0 |
| MAGWELL | CQC/LONG | 95° | 45° | 10° | 5° | 5° | 30° | 0° | 80% | 3.5 |
| Weapon Weight: | | 9 lbs. | | | | | | | 100% | |

*AWKWARD POSTURE

In fact, the positions for general-purpose and long-distance shooting would become a much better alternative in extended CQC engagements.

Other Aiming Aids

For more aiming stability: The foregrip front end surface (1F) can be pushed against a barricade using the foregrip as a barricade stop, or the rear end surface (3L) can be rested on the floor or other suitable surface using foregrip as a monopod, or surface (3B) on a barricade, bench, sandbag or bench block.

Quick Draw Carry System

The foregrip described herein, enables a very efficient, multi-mission, highly ergonomic and convenient Quick Draw Carry System (QDCS) for long-barreled firearms that enhances firearm safety, deployment, carrying, mounting, reloading and feeding stoppage remediation, as well as, user's survivability, mobility, and endurance.

The Quick Draw Carry System described herein, is designed as an integrated whole, such that, all its components interact, interdepend, work together and enhance the others' functions and features. The QDCS comprises four (4) components:

- Sling type
- Foregrip and Sling configuration (Foregrip subject of this patent and Sling type with weapon system relationship)
- Firearm's carry style (Foregrip and Sling configuration with operator relationship)
- Firearm carrying and handling procedures

Detailed QDCS Component Description

Figure 3:
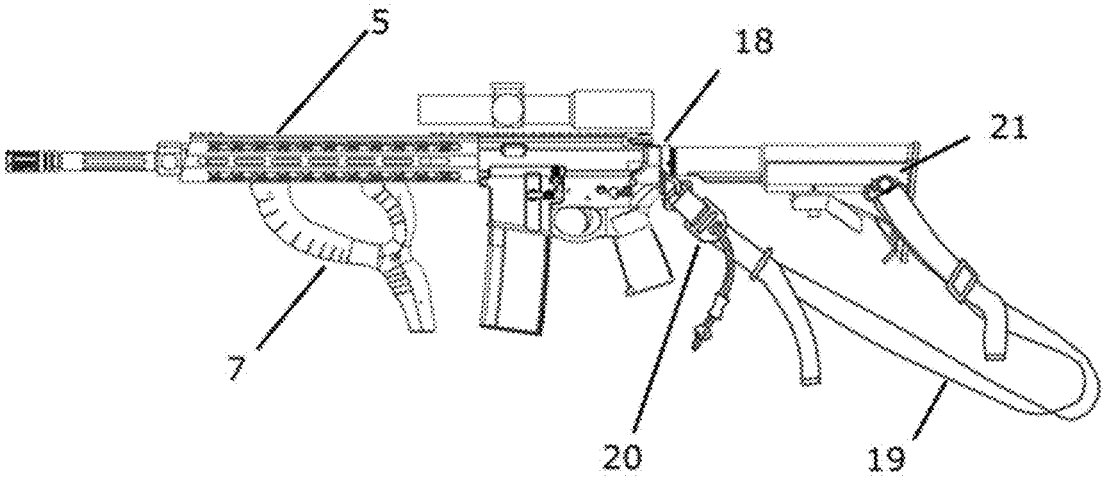
FIG. 3: Long-barreled weapon system with attached sling configured as per QDCS subject of this patent

Sling Type:

The QDCS sling is one of the two-points type, being short, simple, light, rigid and with length adjustment in one end. Basically, any type of sling will work, preferably, the sling has the adjustable length buckle that remains in the same position regardless of how loose or tight the sling is; the ends have quick-connect swivel terminals or another adequate connection method most suitable to the firearm to be set up and user's preference. See FIG. 3., it shows the Multi-Mission foregrip (7) attached to the modular handguard (5) and the QDCS sling (19). The sling's length adjustment buckle end (20) is attached to the lower receiver end plate (18) and the other end (21) is attached to the rear side of the buttstock, in the FIG. 3, it is shown attached for a lefty shooter.

Foregrip and Sling Configuration:

Some trial and error may be involved to set the position of foregrip along the handguard, considering handguard length limitations, body makeup, long distance, and close-range shooting missions, and magwell clearance for reloads. The handguard, for the AR platform, minimum length to support all available positions is 12.3". See FIG. 3.

The QDCS sling is configured attaching the sling end-point with length adjustability to the receiver end plate, and the other end connecting the buttstock's side by its heel (for a right-hander the same side as ejection port, connector attached with a right-hand half twist). Basically, the sling is confined within the buttstock, attaching it using two points separated approximately the buttstock's length.

Sling length should allow performing all carrying and handling procedures; no further in field adjustments will be required, except the mini hasty sling, see stowing procedure.

QDCS does not inhibit user to switch to a conventional 2-point sling configuration provided that at least one sling end-point and the sling length can be changed in the field, although this doesn't provide any advantage over the QDCS.

Besides, QDCS sling provides a safe and efficient method to store rifles vertically using a simple hanger on a wall.

Firearm Carry Style:

This improved QDCS confines the long-barreled firearm in front of and across the user's chest with firing grip pointing upwards and the muzzle pointing down and towards user's weak side and comfortably distributes weapon's weight between the foregrip grabbed by the support hand and the two-point sling, described and configured herein, wrapped around the neck. Support hand grabs foregrip, the subject of this patent using a very neutral posture, in one of the eight (8) options listed in DETAILED GRIP POSITIONS item D to fine tune: Mission, wrist posture, weight distribution, muzzle, and buttstock position. See FIG. 7A thru 7F.

Sling length should be adjusted as short as possible before the mission, wearing full gear and still being able to perform all carrying and handling procedures comfortably; no further adjustments will be required, except the two methods to organize a mini hasty sling, five (5) points of contact, where the sling adjustment buckle will be needed, see stowing procedure.

Description of QDCS's Procedures to Carry and Handle Long Barreled Firearms

The Quick Draw Carrying System (QDCS) described herein, would streamline the procedures to handle firearms; certainly, the QDCS would smoothen the training path. Following procedure specifications apply to the AR-15, AR-10, M16, M4 platforms, similar procedures can be developed to most other magazine feed platforms.

1. Procedure to configure foregrip, carry sling and carry style
2. Procedure to mount the firearm
3. Procedure to stow weapon away
4. Procedure to reload and feeding stoppage remediation
5. Procedure to transition from one shoulder to the other (Will not be included as a claim.)

(Named styles and Sling type: 1 Point Sling: 1PS, 2 Points Sling: 2PS and 3 Points Sling: 3PS, and Hasty sling and Bicep Cuff or Loop sling variants have marks for current art reference and comparison when apply, the longer mark the worst)

Figure 6:
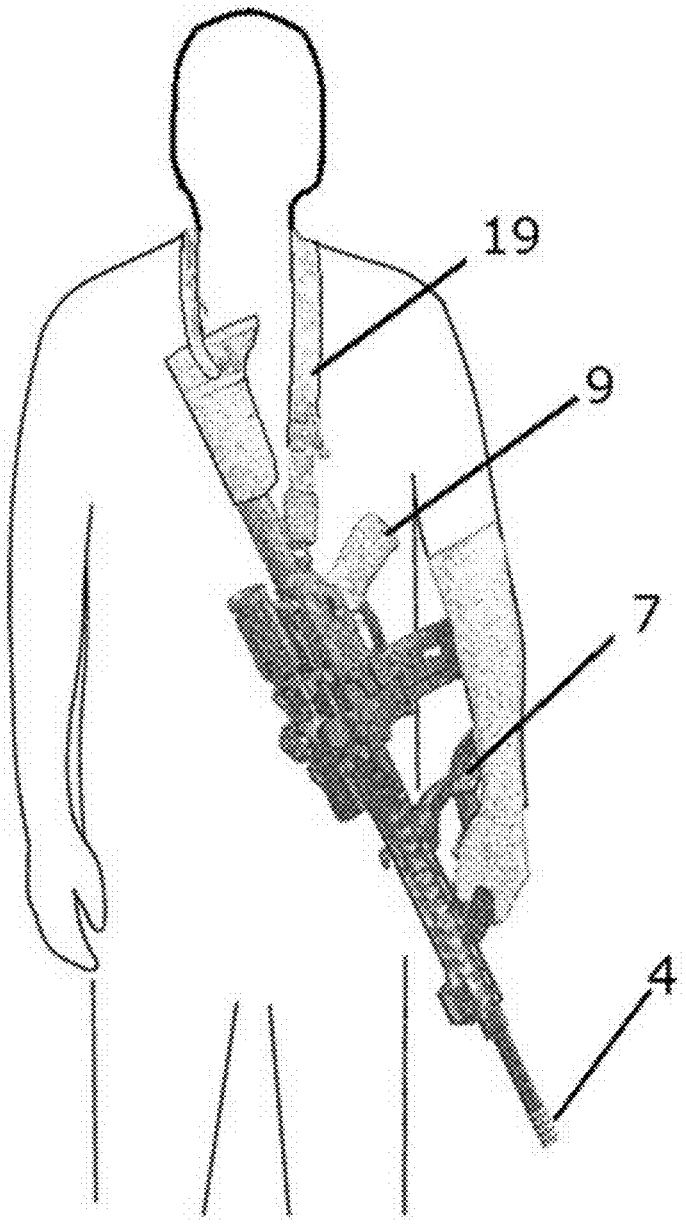
FIG. 6: Quick Draw Carry Style FIG. 7A Quick Draw Carry System showing the tune up of wrist posture, weight distribution, muzzle and buttstock positions FIG. 7B Rifle Carry using Rear Upper of Multi-Mission Foregrip

1. Procedure to Configure Foregrip, Carry Sling and Carry Style a) Install Foregrip on firearm handguard. Some trial and error may be involved to set the best position along the handguard. To settle a position, consider handguard length limitations, personal makeup, long distance and close-range shooting missions and magwell clearance for reloads. Choose sling end terminal attachment hardware best suited to the weapon to be set up and the user's preference. Be aware of noise, movements freedom, attachment speed and positive lock within the sling and the weapon.

b) Install one or two endpoints terminal attachments to the sling from point b)

c) Install sling on the firearm. The sling end-point with length adjustment buckle connects to the receiver end plate, and the other to the side by the buttstock's heel (for a right-hander the same side as ejection port, connector attached with a right-hand half twist for the mini hasty sling). See FIG. 3.

d) Prepare carry style wrapping the sling around the neck and hang weapon.

e) Rest the long-barreled firearm in front of and across the chest leaving the firing grip pointing upwards and muzzle pointing down and towards the user's weak side. See FIG. 6.

f) Adjust sling length as short as possible before the mission, wearing full gear and still being able to perform all handling procedures comfortably. In principle, no further adjustments will be required, except the mini hasty sling, see stowing procedure.

g) Grab the foregrip with the support hand in one of the eight (8) options previously listed in DETAILED GRIP POSITIONS item D to fine tune: Current mission, wrist posture, weight distribution, and muzzle and buttstock position. See FIG. 7A thru 7F h) The most efficient magazine orientation in a chest rig's vertical pouch is storing magazines bottoms up and the arched end pointing towards the right side for both right and left-handers. Support hand to grasp with wide grip closing fingertips on the magazine's arched sides.

2. Procedure to Mount the Firearm: See Maneuver Sequence in FIG. 8A Thru 8D.

Response Time from carrying to firing is shorter than drawing a pistol and almost as fast than the muzzle down ready position. Particularly hunters, left-handed and female shooters, operators carrying chest gear and users of extra-long rifles would take advantage of it. Because of its nature, QDCS offers a safer alternative to maneuver within crowded groups than both ready positions, the user always keeps full muzzle awareness[8] and never loses sight of the target.

Figure 5G:
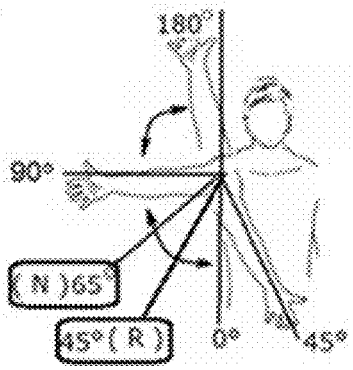
FIG. 5G: Shoulder Joint range of motion: Abduction rising arm from [N] 65 deg. to the side and up 180 deg. Vertical. Adduction: Arm turns from [N] abduction down and over chest to 45 deg. [R]=30/45 deg, typical Rifle Mount is not considered awkward posture

Start with the Quick Draw Carrying position, support hand grabs foregrip as per item h) of the previous procedure:

a) Simultaneously, use firing hand to grasp buttstock comb's end then make an arm abduction (see FIG. 5G) and forearm flexion (see FIG. 5A) to rise, roll and sit buttstock's heel on shoulder pocket or plate carrier vest resting the buttstock's comb against cheek while support hand raises muzzle towards the target and finishes maneuver firmly sitting buttstock's heel against shoulder pocket b) Firing hand makes the firing grip, wedges down buttstock to lock it into shoulder pocket assuring a firm cheek weld then move eye forward a bit to start natural point of aim[5]

Most likely the buttstock would be shouldered and leveled at the correct aiming elevation. Users in high alert might be grabbing buttstock saving time. Apply Standing Posture Best Practices[6].

Figure 10A:
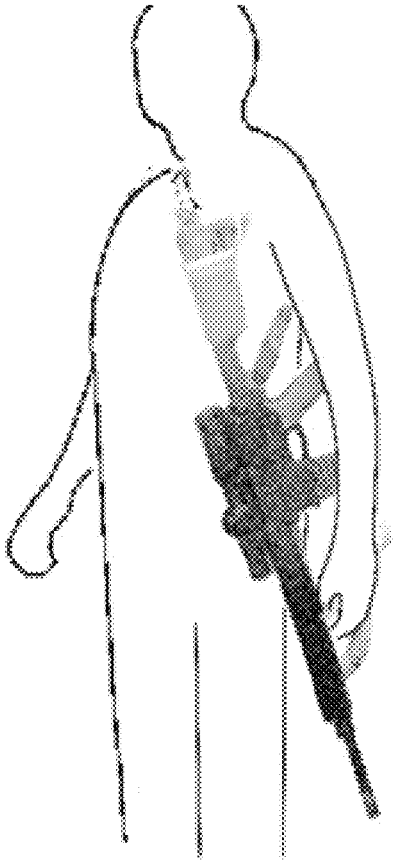
FIG. 10A: Quick Draw Carry System Stow away option 2
Figure 10B:
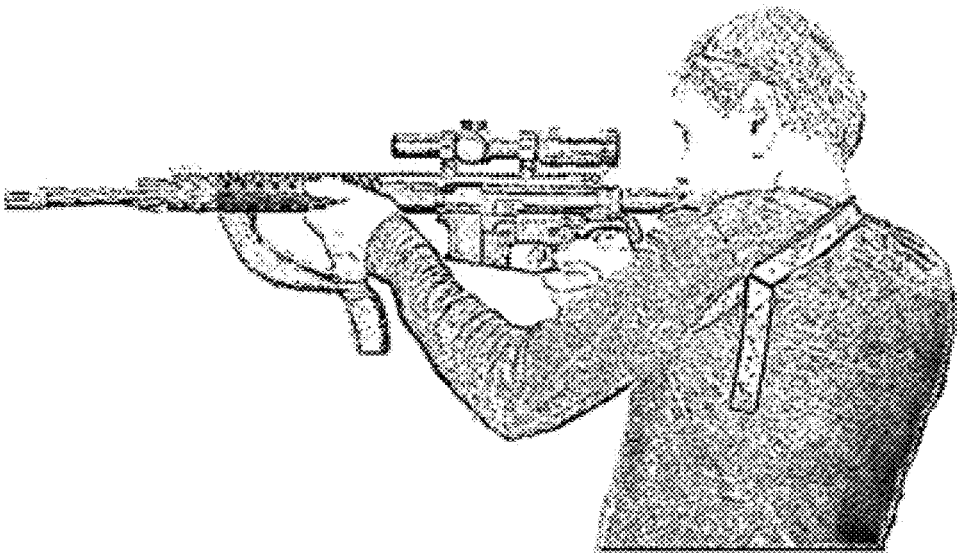
FIG. 10B: Mini Hasty Sling carry option 2

Attempting to grab firing grip instead may cause chest rig interference and lost target sight, and hand grabbing firing grip would result in an awkward posture. With just adjusting the sling tension a mini hasty sling can be configured see FIGS. 96 and 10B.

(American--- European-- African- Hasty--- Bicep cuff---- 3PS--)

3. Procedure to Stow Weapon Away:

There are two ways to stow the weapon away, improving the degree of retention and freeing up both hands, for example, climbing, handcuffing, low (belly) crawling, running, carrying or pulling a load. This procedure is impossible using a single point sling (1PS) without adding supplemental hardware and manipulations.

Figure 9A:
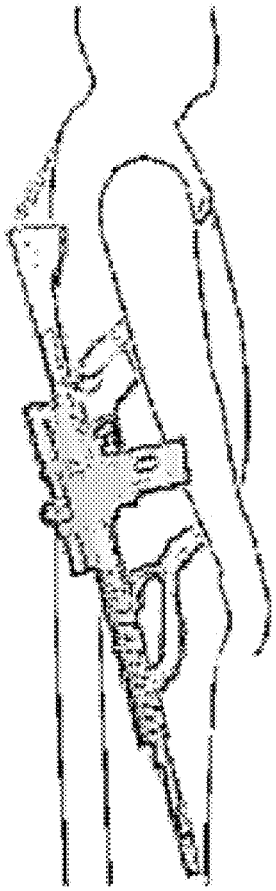
FIG. 9A: Quick Draw Carry System Stow away option 1
Figure 9B:
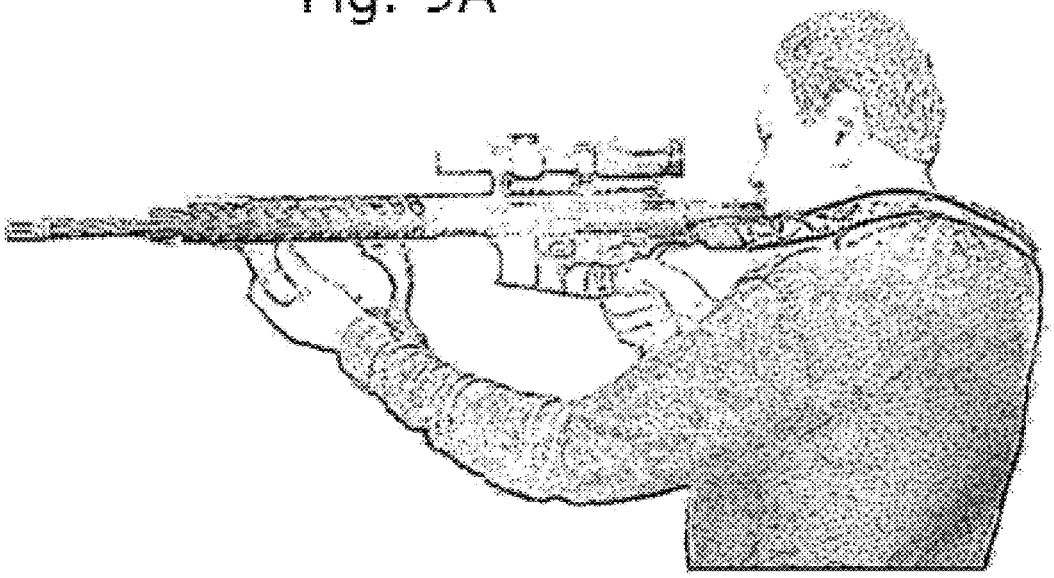
FIG. 9B: Mini Hasty Sling carry option 1

First method—Weapon would rest on the back and follow its movements: See FIG. 9A a) Thread strong arm through the sling b) Grasp handguard and throw firearm to the back, firing grip would end pointing forward Mini hasty sling For a quick mounting from this stowed position, a mini hasty sling could be configured, as well, if the sling type is as recommended leaving available the length adjustment to provide five (5) points of contact and making a firmer retention and cheek weld. Also, the mini hasty sling is handy for one hand operation, supports all stances and releasing sling tension would support both ready positions and shoulder transitions. It will improve the kneeling or sitting stance in combination with any of the grip positions for long distance and intermediate shooting of claim 7 items (A) and (C).

Firing hand grabs handguard to raise and roll muzzle to transfer weight to support hand that begins grabbing foregrip per item h) of procedure No. 1.

Strong hand releases handrail and grabs buttstock comb's end

Support hand finishes muzzle rolling while dominant forearm flexion and arm abduction sit buttstock on shoulder pocket and finally dominant hand grabs firing grip Adjust sling tension with length adjustment buckle and passing sling above or below buttstock.

During the maneuver, be aware to relieve sling pressure to avoid dragging, there is no need to manipulate the sling. See FIG. 96.

Alternate method—Firearm buttstock would tuck in by the weak side armpit: See FIG. 10A.

Thread weak arm through the sling a) Grab foregrip to leave weapon hanging to the side, firing grip would end pointing backward Mini hasty sling For a quick mounting from this stowed position, a mini hasty sling could be configured, as well, if the sling type is as recommended leaving handy the length adjustment to provide five (5) points of contact and making a firmer retention and cheek weld. Also, the mini hasty sling is useful for one hand operation, supports all stances and releasing sling tension would support both ready positions and shoulder transitions. Its retention is tighter than the other method and it is particularly accurate in the kneeling or sitting stance in combination with any of the grip positions for long distance and intermediate shooting of claim 7 items (A) and (C).

Support hand grabs foregrip and strong hand grabs buttstock comb's end to raise and roll muzzle A dominant forearm flexion and arm abduction sits buttstock on shoulder pocket and finally grabs the firing grip Adjust sling tension with length adjustment buckle and passing sling above or below buttstock.

During the maneuver, be aware to relieve sling pressure to avoid dragging, there is no need to manipulate the sling. See FIG. 10B.

(1PS----)

4. Procedure for Reload and Feeding Stoppage Remediation

The QDCS enables a unique very safe and efficient ambidextrous kneeling reload and feeding stoppage remediation for most magazine feed firearms. See Reload Feeding Stoppage Remediation[7]

In the current art, reload and feeding stoppage remediation uses firing hand to support firearm's entire weight, therefore, disabling secondary weapon's, and creating unstable, obtrusive and awkward workspaces. Worst of all, it makes the standing operator vulnerable and worst of all, helpless.

The QDCS RFSR, the kneeling position enables to hold the weapon's weight between thigh and neck leaving both hands available to be used on a very stable and accessible workspace and keeping available the QDCS fast deployment of the secondary weapon. The QDCS RFSR is very safe leaving muzzle down and firing hand off the grip, in fact, firing hand purpose changes to assist the work done by the support hand. Furthermore, the kneeling position makes the shooter easier to cover and a target harder to hit.

Firing grip points up to create an excellent workspace exposing ejection port, bolt carrier position, chamber, ejection chamber, magazine well, and offers a very good posture to use the AR standard magazine release, bolt catch, and charging handle; it would reduce the need for ambidextrous enhancements to those parts; also it opens access to chest and weak side rig and eliminates magazine reorientation for insertion/storage.

Furthermore, it would extend the time between malfunction of recycled magazines that are the cause of most feeding stoppages. Magazines' operation should be checked before the mission as any other part of the weapon system.

In the case of semi-automatic or fully automatic firearms, if the weapon stops reloading and the trigger is locked, the weapon is ready to be reloaded with a new full magazine or there is a feeding stoppage in progress.

The operator personal safety must take precedence before any other action is to be taken.

a) Intent to find cover, move weapon to quick draw carry position and run while drawing the secondary weapon covering yourself until reaching physical cover b) Go kneeling, strong knee on the floor, while resting handguard on the thigh, point muzzle in a safe direction. Dominant hand to assist support hand operation c) Use foregrip to roll weapon exposing ejection port. Assess stoppage seen thru the ejection port: If Bolt is locked to the rear, and ejection chamber and chamber are empty, the firearm is ready to be reload. No feeding stoppage remediation is needed d) Use foregrip to roll rifle until the magazine is pointing up, support hand to release, grab magazine by its center and remove it a. If No Remediation is needed continue with step (l=store) or throw magazine and continue with step (m=verify magazine well)

b. If this is a Voluntary Stoppage-Magazine is not empty-Technical Reload- go to step (k=store aside)

e) Stoppage remediation begins:

If you were able to feel the clues that the movements and stops of hammer, bolt, buffer and buffer spring action give, you should be able to confirm them now, if not, you must pay closer attention to the ejection port and chamber. The interest should be concentrated in the chamber and magazine condition and fix the stoppage as soon as possible.

Safely tuck magazine under the chin or armpit or on the floor. This temporal stowing would allow waiting until gathering enough information to take care of it.

f) Roll weapon leaving ejection port facing towards the floor, use support hand to push foregrip forward (if support hand is impaired put muzzle on floor and foregrip behind thigh) and attempt to pull firmly charging handle backward with strong hand index and middle fingers, or thumb and index finger.

If the charging handle moves then clear chamber and ejection chamber, assist burnt case, unfired round, offending brass, and debris dumping by rolling weapon back and forth while charging and releasing bolt a couple of times.

a. If the burnt case or unfired round remains stuck in the chamber the weapon is off the fight and needs service b. If nothing comes out or chamber remains empty or if brass was dropped and the chamber was cleared, then continue with step (h=lock)

g) Charging handle stuck, it doesn't move because there is an internal jam then you need more leverage than your bare hands can deliver: Release weapon, support hand to grab foregrip position VI to rest buttstock in front of your weak foot's toes, rolling rifle placing charging handle latch towards you, place strong hand on floor to create a body's tripod, place side edge of your weak foot boot's heel on the handle's latch and give it a strong kick downwards:

a. If jam was not released this weapon is out of the fight it needs service b. If jam was released: Clear chamber and ejection chamber assist the offending brass and debris dumping by rolling weapon back and forth while charging and releasing bolt a couple of times If the burnt case or unfired round remains stuck in the chamber the weapon is off the fight and needs service If they were cleared and brass was dropped then rest handguard on the thigh and wrap sling back to the neck, continue with step (h=lock)

h) Lock bolt to the rear: Push Bolt Catch Paddle's bottom small pad and pull bolt backward. Insert and lock charging handle.

i) Grab magazine stowed under the chin or armpit; no reorientation needed if using support hand j) Take care of the magazine:

a. Stovepipe cleared (T2)

If magazine not empty—continue with step (m=verify magazine well)

If magazine empty—continue with step (l=store)

b. If offending brass out (T1, T3)

Magazine not empty—Check lips, follower, and spring operation—tap to sit bullets—try it once again continuing step (m=verify magazine well). If it fails again—continue step (k=store aside) or throw it and continue with step (m=verify magazine well)

If Magazine empty—Check lips, follower, and spring operation—throw it and continue with step (m=verify magazine well) or step (k=store aside)

c. If no offending brass out and chamber is empty

Magazine not empty—Check lips, follower and spring operation—tap to sit bullets—try it once again continuing step (m=verify magazine well). If it fails again—continue step (k=store aside) or throw it and continue with step (m=verify magazine well)

If Magazine empty—Check lips, follower and spring operation—throw it and continue with step (m=verify magazine well) or step (k=store aside)

k) Store magazine aside—continue step (m=verify magazine well)

l) Store magazine m) Verify the magazine well is clear. If it is not, roll magazine well towards the floor to dump brass debris, fingers may help the dump. Verify again n) Pick up magazine fully loaded from pouch grabbing it by its side center or bottom o) Insert magazine, push it down until feeling the lock click. A simple pull out test will be more than enough to confirm that it is fully locked p) If this is a Voluntary stop or Technical Reload, there is a round in the chamber, skip the next step.

q) Chamber a round: Push Bolt Catch Paddle's top large pad to release bolt to load the chamber r) The firearm is ready to go back shooting (Current art standing loading and feeding stoppage remediation------)

5. Procedure to Transition from One Shoulder to the Other

Necessary for dynamic situations looking for right or left cover standing or kneeling. There are two methods without the sling interference and manipulation like using 2PS and 3PS.

Full transition:

a) Firing hand switches position from firing grip to magwell b) Old support hand releases foregrip c) Firing hand transfers buttstock above sling and down into the other shoulder pocket d) Old support hand grabs firing grip e) Old firing hand switches position from magwell to the foregrip Quick transition:

One step: Support hand moves closer to magwell to allow manipulation, firing hand transfers buttstock above sling and down into the other side shoulder pocket. Good for just a few shots. This procedure is the same as for 1 Point Sling configurations.

(=1PS 2PS- 3PS-)

Quick Draw Carry System Improvements Over Current Art

The (QDCS) improvements over current art: carry styles, sling designs, sling configurations and procedures are categorized as follows:

Named styles and Sling type: 1PS, 2PS and 3PS, and Hasty sling and Bicep Cuff or Loop sling variants have marks for current art reference and comparison when applying.

Safety: QDCS is inherently safe leaving strong hand off the firing grip, completely free, relaxed and rested, and the muzzle pointing down most likely in a safe direction, keeping chamber and bore dry, and muzzle clean from debris, even when kneeling or sitting the muzzle will remain far from the floor. QDCS encourages muzzle awareness[8] while walking.

QDCS Reload and Feeding Stoppage Remediation (RFSR) in the kneeling position makes operator easier to cover and a target harder to hit; it also maintains firing hand off the grip, therefore, both hands always have unobstructed paths for fast deployment of a secondary weapon improving survivability; this is a very innovative tactical advantage.

(American- European- African--)

Deployment, Manipulation, and Transition to Ready: In the QDCS weapon always rests in front of the user's chest ready for quick access, and deployment and manipulation would become very efficient and easy because of the reduction of firearm's handling, weapon's fishing, sling manipulation, and adjustments during the mission.

Response Time from carrying to firing is shorter than a draw of a handgun, users in high alert might be grabbing buttstock saving extra time; furthermore, QDCS time to firing is almost as fast as from the ready positions, however, considering that QDCS is more energy efficient and adding the fact that the firing hand would be kept relaxed and rested, it would be better conditioned for trigger control and faster shooting, enhancing accuracy and consistency; knowing that a rifle is inherently more accurate than a handgun makes this is a very innovative tactical advantage.

The QDCS would further develop rifle ready positions with the muzzle pointing up or down. Even if the weapon was stowed (2 methods) deployment is still fast, furthermore, enabling five (5) contact points aiming aids that are useful in all stances; this is a very innovative tactical advantage. See mounting procedure and mini hasty sling in stowing procedure.

The QDCS would increase endurance in the muzzle down and up ready positions using the support provided by the sling.

The QDCS transition to the prone stance is no different than using a weapon without a sling, in fact, it uses the same procedure, there is not a single compromise with speed, stability, adjustments, removability, interference or manipulation.

(American--- European-- African- Hasty sling-- Bicep cuff---- 3PS--)

Ergonomics, motions and energy economy and ambidexterity: The QDCS is based on a very neutral body posture of wrists, elbows, and shoulders that is maintained throughout all required firearm manipulations and minimizing unnecessary motions and energy waste, as well as, sling length adjustments and handling; furthermore, the system relieves the firing hand load and it is fully ambidextrous; this is a very innovative tactical advantage. Furthermore, its operation enables right and left-handers to perform same procedures, even for reloading and feeding stoppage remediation; furthermore, a simple firearm's rolling would reduce the need of ambidextrous enhancements of AR changing handle, magazine release and bolt catch.

(American-- European- African- Hasty sling--- Bicep cuff----)

Interferences: The QDCS sling, confined to the buttstock, eliminates interferences between the sling with all firearm mechanisms and cartridge ejection path. Also, the weapon is confined within the body, therefore there are no interferences, visual or physical, with the surrounding field or target.

One fast forearm flexion and arm abduction will shoulder the weapon rendering perfect cheek weld due to the arm and forearm matching lengths, furthermore, clearing most chest mounted protecting and survival gear, see FIG. 8A thru 8D Also, the drawing path of secondary weapon holstered on the strong side is completely clear; therefore, using the secondary and bringing the rifle back to action is quite fast and energy efficient because it doesn't require to sweep the rifle to the outside or behind the secondary to clear the draw, in fact, the secondary is always available to the free firing hand including during the QDCS reloading and feeding stoppage remediation.

(American--- European-- 1PS--- 3PS---- 3PS is constrained to only right-handed shooters.)

Retention and Mobility: The QDCS provides a controlled retention of the weapon for long distances, as well as, for mobility, even if user releases the foregrip the retention is quite enough without bouncing, therefore, it eliminates the nasty 1PS pendulum effect, furthermore, it doesn't require supplementary hardware, sling length adjustments, and manipulations. In fact, QDCS doesn't inhibit user to completely release the support hand grip.

QDCS achieves with a simple movement of an arm even more retention: Stowing weapon away and freeing up both hands without adding supplemental hardware and without a major weapon or sling manipulations.

In the other hand, Mobility would improve over current art, the QDCS achieves the appropriate body balance with free to move arms, weak arm supports one firearm's end while running at high speed, with frequent stops and run, and in different directions; this is a very innovative tactical advantage. In addition, the foregrip and sling enhance endurance due to the neck support and available release of the firing hand stress.

Furthermore, the QDCS doesn't inhibit the user to choose the conventional run with a weapon in the back neither with buttstock over the shoulder in the muzzle down ready position for lateral moves.

(1PS----)

Releasing Weapon: The QDCS allows easy and fast weapon release just removing the sling from the neck, for example, when sitting inside vehicles, boats or helicopters, in crowd control scenarios, unjamming the weapon, or CQC.

Releasing weapon from the mini hasty sling (5-points of contact) is easy, comprising two steps: Unthread arm from the sling and then remove the sling from the neck; being the one using weak arm a bit longer using the weapon itself.

Even that a short sling minimizes tangling hazards, optionally, the sling can be contained with a rubber band against the buttstock to avoid being tangled when it is not in carrying mode.

(Hasty sling-- Bicep cuff----)

Reload and Feeding Stoppage Remediation (RFSR). The QDCS enables a unify very safe and efficient kneeling RFSR procedure that includes several innovations over the current art.

In the current art, the user supports the firearm's entire weight using the firing hand grabbing grip, therefore, secondary weapon's is disabled and creates unstable, obtrusive and awkward workspaces. Besides, it makes the standing operator quite vulnerable and worst of all, helpless.

In the QDCS RFSR, the kneeling position enables to hold the weapon's weight between thigh and neck leaving both hands available to be used on a very stable, open and accessible workspace. Furthermore, the QDCS and RFSR maintain unobstructed paths to both hands for fast deployment of a secondary weapon and the kneeling position makes the operator easier to cover and a target harder to hit.

Firing grip points up to create an excellent workspace exposing ejection port, bolt carrier position, chamber, ejection chamber and magazine well, and revealing AR standard magazine release, bolt catch and charging handle, which would reduce the need of ambidextrous enhancements to those parts; also opening space for chest and weak side rig access and eliminating magazine reorientation for insertion/storage; this is a very innovative tactical advantage.

Even more, it is very safe leaving muzzle down and firing hand off the grip, in fact, firing hand purpose changes to assist the work done by the support hand then it would be ready to deploy the secondary weapon at any time.

Furthermore, it would extend the time between malfunction of recycled magazines that are the cause of most feeding stoppages.

(Current art-----)

Mission and Weather constrains: The QDCS supports all mission and weather conditions, as well as all garments and gloves types. Sling manipulations and adjustments are virtually eliminated during the mission (American-- European-- African- 1PS--- Hasty sling-Bicep Cuff- 2PS- 3PS---)

Concept Definitions within the Scope of this Patent

1—Weapon Control

Within the scope of this patent, Weapon Control is the action that starts with the support hand holding up the foregrip subject of this patent, located towards the front end of a long-barreled firearm, to provide a stable support to the weapon's front end weight, and with a good purchase of the foregrip to ensure a controlled rotation while driving the muzzle up, down or sideways towards different targets and also, to roll weapon to handle canting shooting (off-axis) in awkward or nontraditional body positions like a rollover prone, all of this with the purpose of acquiring a target at the fastest speed possible, and ends keeping the desire sight alignment steady to get ready to fire. And, simultaneously applying enough force to sit the buttstock against the shoulder (mounting the weapon) or pushing forward to stabilize firearms without buttstock (also, serves for muzzle strikes) getting ready to mitigate recoil after shooting.

2—Recoil Mitigation

Within the scope of this patent, Recoil Mitigation or Management is the action that starts with the support hand holding up the foregrip subject of this patent and to simultaneously apply enough force to sit the weapon against the user's shoulder along a parallel line below and far from the bore axis to withstand, after shooting, the firearm recoil and muzzle raise momentums with the purpose of reacquiring the target at the fastest speed possible (or shot follow up), and ends keeping the desire sight alignment steady to get ready to fire again.

3—CQC

Within the scope of this patent, Close Quarters Combat, also known as CQB for Close Quarters Battle, is a very dynamic shooting at close range, urban and confined space engagement scenarios that will push the limits of Weapon Control and Recoil Mitigation to the highest level.

Lately, it is part of high-speed shooting games, like 3-gun competitions.

4—Mobility

Within the scope of this patent, Mobility is the action that starts carrying the firearm while running at any speed, zigzagging with frequent stops avoiding obstacles, ending at the time to mount the weapon, for example running for cover.

Mobility would be improved upon the use of the foregrip subject of this patent within the Quick Draw Carry System (QDCS), also subject of this patent, because the QDCS achieves the appropriate body balance with free to move arms, weak arm supports one firearm's end, while running at high speed, with frequent stops and run, and in different directions to avoid obstacles. Furthermore, in the QDCS the foregrip and sling enhance endurance due to the neck support and available release of the firing hand stress. Finally, the QDCS doesn't inhibit the user to choose the conventional run with the weapon in the back neither with buttstock over the shoulder in the muzzle down ready position for lateral moves.

5—Natural Point of Aim

Within the scope of this patent, Natural Point of Aim or Zero Position is the neutral aiming posture that the body wants to maintain once the desired sight alignment is established. To find this posture begin aiming at the desired target, close eyes, move muzzle to right then center then to left and back to the start, open eyes, if sight alignment happens to be the same as the original one then you found the Natural Point of Aim for this shot. Otherwise, slightly relocating feet to rotate the body to realign muzzle or moving support hand closer along foregrip bridge or lowering hand grip along the rear end of the foregrip to raise muzzle or vice versa, check again until reaching it. This procedure will become second nature with conscious practice. Furthermore, its neutral ergonomic character minimizes muscle vibration, shaking and fatigue, and maximizes control and force production potential of the joints muscles for faster response and wider range weapon control, shooting accuracy, recoil mitigation, consistency, and endurance.

6—Standing Stance Best Practices

Within the scope of this patent, standing stance best practices are the foundation for accurate shots and to build the Ergonomic Natural Point of Aim posture faster and minimizing fatigue, muscle vibration, shaking and eventual pain, and energy consumption, furthermore, maximizing the potential of muscle control and force production in the standing stance.

Standing stance best practices:

- Step forward towards target:
  - Weak foot to lead with heel aligned with strong foot toes (as half step forward)
  - Feet angled as a casual chat and apart as shoulder width (as a normal walk)
  - Weak knee bent to align hips with the foot's ball
  - Strong leg knee bent to turn hips towards the target and lowering body's center of gravity
  - Both feet' ball and heel on the ground for a solid balanced foundation
- Arms:
  - Arms opened (Shoulder abduction) ~30° degrees, creating shoulder pocket.
  - Weak elbow bent 35°-85° degrees and strong elbow ~90° degrees
  - Choose foregrip hand position and pre-adjust buttstock position (most likely fully extended)
- Head and back:
  - Body weight balanced between both feet
  - Keep straight back, shoulders leveled and aligned with hips
  - Lean a bit forward to align nose with leading edge of weak foot toes
  - Keep head erected, chin parallel to the ground
  - Move eye slightly forward to start sight alignment
- Shrugging shoulder up and forward and hunching should be avoided because these practices change aiming eye-scope relationships hurting consistency, affect vision field of view, render very awkward postures and don't increase body's mass.
- Preset scope or red dot eye relief position such that moving the head forward just a bit you can start sight alignment, remember the influence of prone position and variable scope magnification.
- This standing stance best practice should allow starting walking forward or backward using half steps with very little sight alignment change.

Standing stance best practices are a balancing act of most factors supporting the firearm that can affect shooting result. Consider the following conditions:

- Weapon System: If elbows open position angle (shoulder abduction) is set as the recommendation above, a hunter using a bolt action rifle will suffer a very awkward wrist position, therefore strong-arm opening must change to almost 90° degrees to reduce wrist strain
- Operator posture and Mission: Leaning over too much, shrugging shoulder forward and up, hunching and fully extending arm forward increase user's moment of inertia, therefore, torso and legs muscles will require more energy to rotate the weapon (shoulders will be no longer aligned with hips; nonetheless, rotation starts in the middle of the range of motion); furthermore, the awkward posture will accelerate joints strain and fatigue. In CQC, this could be an important issue but not in long range accurate shooting 7—Note about Reload and Feeding Stoppage Remediation From every point of view, current firearm reloading and feeding stoppage remediation in the standing position puts the operator in a quite vulnerable condition and worst of all, helpless; therefore, training firearm reload and feeding stoppage remediation standing supporting weapon with firing hand should be removed from shooting training manuals making such critical practices safer gaining a survival advantage.

8—Firearm Safety Rules

Safety must be before everything else:

1. ALWAYS treat firearms with respect as if they are loaded and ready to fire, they are lethal tools
2. ALWAYS keep firearms pointed to a safe direction, never let the muzzle or sights on a target that you are not willing to shot, destroy or kill. ALWAYS maintain muzzle awareness
3. ALWAYS keep your finger off the trigger until your sights are on target and you have made the conscious decision to pull the trigger
4. ALWAYS know your target and the environment around it, what's to each side and up and down, and include what's beyond and before it
5. Don't let your ego kill you or a loved one or an innocent bystander, ALWAYS make safety your main priority, assess the risk, take care, intervene and follow the rules

Omissions within the Scope of this Patent

Omissions: Within the scope of this patent, trigger control, safety lever handling, firing, breathing, sight alignment, and shop malfunction mitigation details are not discussed, nonetheless, the practice of most of them will be improved upon the use of the foregrip described herein, rendering safety, efficiency, shooting accuracy and consistency, if their best practices are applied.

Moment of Inertia is omitted. A snapshot of its effect is apparent in figure skating spins, skater rotates around the body's center of gravity and can reduce rotational speed just hunching and opening arms to the side, and vice versa. For a rotating object with a given mass, the farthest the mass is from its center of rotation the largest the moment of inertia will become, therefore, opening arms the rotation slows down to conserve the momentum of the system. If the goal is to keep the speed up additional torque must be applied to counteract the increase of moment of inertia, doing so more energy will be consumed.

The invention claimed is:

1. A detachable foregrip for a firearm, comprising:

a combination of first, second and third foregrips in a single unitary body adapted to detachably attach to the firearm, the single unitary body characterized by a bi-dimensional closed loop layout created with smoothly connected curved profiles, the single unitary body dimensioned to match a hand of a user, the single unitary body outlining:

a front end zone comprising the first foregrip, the front end zone adapted to attach closest to a muzzle of the firearm;

a rear end zone comprising the second foregrip, the rear end zone comprising a rear upper zone adapted to attach closest to a trigger of the firearm and a rear lower zone resembling a pistol grip; and a bridge zone comprising the third foregrip, the bridge zone connecting the front end zone, the rear upper zone and the rear lower zone together;

the front end zone comprising:

a top flat surface adapted to attach the first foregrip to a handguard of the firearm, an upper front profile rounded with a steep slope angle ending vertically, a rear profile rounded with a curve close to 90 degrees, and a lower front profile rounded with a smooth slope angle;

the rear upper zone comprising:

a top flat surface adapted to attach the second foregrip to the handguard, an upper front profile rounded with a steep angle, a lower front profile rounded with a smooth angle, a bottom profile rounded to provide a wide sloped bridge relief, and a back profile rounded with a curve close to 90 degrees;

the rear lower zone comprising:

a front distal profile, a rear proximal profile, a rear recessed rounded surface, and a bottom flat surface; and the bridge zone comprising:

a lower front profile across a middle of the bridge zone, an upper smooth sloped profile, and a lower rear profile close to the rear end zone.

2. The detachable foregrip according to claim 1, further comprising:

a 3D shelled solid body with surfaces created connecting a plurality of cross-sections;

the plurality of cross-sections comprising two offset ellipses;

wherein the 3D shelled solid body has a thickness between 2 to 3.5 mm, wherein:

the front end zone has a plurality of at least substantially oval cross-sections with their minor axis extending between the upper front and rear profiles, and lower front and rear profiles, the rear upper zone has a plurality of at least substantially oval cross-sections with their major axis extending between the upper front and back profiles, with their minor axis extending between the lower front and back profiles, between the bottom and back profiles, and between the bottom profile of the rear upper zone and the rear recessed rounded surface of the rear lower zone, the rear lower zone has a plurality of at least substantially oval cross-sections with their major axis extending between the lower rear profile of the bridge zone and the rear recessed rounded surface of the rear lower zone, and with their minor axis extending between the front distal and rear proximal profiles, the bridge zone has a plurality of at least substantially oval cross-sections with their minor axis extending between the lower front and upper smooth sloped profiles, between the lower rear profile of the bridge zone and the bottom profile of the rear upper zone, and between the lower rear profile of the bridge zone and the rear recessed rounded surface of the rear lower zone.

3. The detachable foregrip according to claim 2, further comprising: two symmetrical halves attached together with mechanical fasteners, or chemically or thermally bonded.

4. The detachable foregrip according to claim 3, wherein the two symmetrical halves are constructed with a high strength polymer, composite or a lightweight alloy and have a knurled or texturized surface finish to improve gripping and reduce slipping, and wherein the two symmetrical halves incorporate tactile marks for consistency, or are covered with a tactile polymeric material or an over-molded rubberized grip.

5. The detachable foregrip according to claim 4, wherein the two symmetrical halves are constructed by injection molding, 3D printing, stamping, forging, casting, machining, welding, and soldering.

6. The detachable foregrip according to claim 5, wherein:

the detachable foregrip is adapted to be mounted on M-LOK platforms;

the detachable foregrip is adapted to be mounted on KeyMod platforms; or the detachable foregrip comprises built-in clamps in the front end zone and the rear upper zone comprising a profile matching a geometry of a MIL-STD-1913 Picatinny rail.

7. The detachable foregrip according to claim 1, wherein the detachable foregrip is configured to provide:

a small bracing distance using the rear end zone;

a large bracing distance using the front end zone; and an intermediate bracing distance using the bridge zone.

8. The detachable foregrip according to claim 1, wherein the detachable foregrip is configured to:

reduce Elbow Extension to a neutral angle between 35° degrees and 85° degrees;

reduce Shoulder Flexion to a neutral angle between 40° degrees and 75° degrees;

reduce Elbow Supination, providing a wide palm angled support, to no supination 0° degrees;

reduce Wrist Supination, providing a wide palm angled support, to no supination 0° degrees up to 20° degrees;

reduce Wrist Extension, providing a wide palm angled support, to no extension 0° degrees up to 15° degrees;

reduce Wrist Ulnar flexion, providing a wide palm angled support, to no ulnar flexion 0° degrees up to 10° degrees; or eliminate Magwell grip on a support hand.

9. A method to configure a tong firearm for Quick Draw Carrying, comprising the following steps:

obtaining a detachable foregrip for a firearm, comprising:

a combination of first, second and third foregrips in a single unitary body adapted to detachably attach to the firearm, the single unitary body characterized by a bi-dimensional closed loop layout created with smoothly connected curved profiles, the single unitary body dimensioned to match a hand of a user, the single unitary body outlining:

a front end zone comprising the first foregrip, the front end zone adapted to attach closest to a muzzle of the firearm;

a rear end zone comprising the second foregrip, the rear end zone comprising a rear upper zone adapted to attach closest to a trigger of the firearm and a rear lower zone resembling a pistol grip; and a bridge zone comprising the third foregrip, the bridge zone connecting the front end zone, the rear upper zone and the rear lower zone together;

the front end zone comprising:

a top flat surface adapted to attach the first foregrip to a handguard of the firearm, an upper front profile rounded with a steep slope angle ending vertically, a rear profile rounded with a curve close to 90 degrees, and a lower front profile rounded with a smooth slope angle;

the rear upper zone comprising:

a top flat surface adapted to attach the second foregrip to the handguard, an upper front profile rounded with a steep angle, a lower front profile rounded with a smooth angle, a bottom profile rounded to provide a wide sloped bridge relief, and a back profile rounded with a curve close to 90 degrees;

the rear lower zone comprising:

a front distal profile, a rear proximal profile, a rear recessed rounded surface, and a bottom flat surface; and the bridge zone comprising:

a lower front profile across a middle of the bridge zone, an upper smooth sloped profile, and a lower rear profile close to the rear end zone;

installing the detachable foregrip on the handguard of the firearm;

installing a sling on the firearm, the sling comprising an end-point with a length adjustment buckle that connects to a receiver end plate; and adjusting sling length to perform handling procedures comfortably.

10. A method to configure the Quick Draw Carrying Style (QDCS) according to claim 9, comprising the following steps:

wrapping the sling around a neck of the user;

hanging the weapon from the neck; and resting the firearm in front of and across a chest of the user wherein a firing grip points upwards and the muzzle points down and towards a weak side of the user.

11. A method to mount a firearm from QDCS according to claim 10, comprising:

grabbing the detachable foregrip with a support hand;

grasping a comb's end of a buttstock making a simultaneously firing hand arm abduction and a forearm flexion to rise, roll and sit the buttstock's heel on a shoulder pocket or a plate carrier vest;

resting the buttstock's comb against a cheek while the support hand raises the muzzle towards a target with the buttstock's heel firmly sitting against the shoulder pocket; and simultaneously making a firing grip with a firing hand and wedging down the buttstock into the shoulder pocket or plate carrier vest.

12. A method to improve retention of the firearm according to claim 9, comprising the following steps:

raising and rolling the muzzle of the firearm to transfer weight to a support hand grabbing the detachable foregrip;

positioning the firearm to sit a buttstock on a shoulder pocket;

passing the sling above or below the buttstock; and adjusting sling tension with the length adjustment buckle.

13. A secondary method to improve retention of the firearm according to claim 9, comprising the following steps:

grabbing the detachable foregrip with a support hand;

raising and rolling the muzzle of the firearm;

grabbing a firing grip of the firearm; and adjusting sling tension with the length adjustment buckle with the sling passing above or below a buttstock of the firearm.

14. The detachable foregrip according to claim 2, wherein:

the plurality of at least substantially oval cross-sections between the upper front and rear profiles of the front end zone have a major axis width between 12 and 34 millimeters (mm), and between the lower front and rear profiles of the front end zone have a major axis width between 16 and 30 mm;

the plurality of at least substantially oval cross-sections between the upper front and back profiles of the rear upper zone have a minor axis width between 12 and 30 mm, between the lower front and back profiles of the rear upper zone have a major axis width between 16 and 36 mm, between the bottom and back profiles of the rear upper zone have a major axis width between 16 and 30 mm and between the bottom profile of the rear upper zone and the rear recessed rounded surface of the rear lower zone have a minor axis width between 16 and 30 mm;

the plurality of at least substantially oval cross-sections between the lower rear profile of the bridge zone and the rear recessed rounded surface of the rear lower zone have a minor axis width between 16 and 30 mm, and between the front distal and rear proximal profiles have a major axis width between 24 and 42 mm; and the plurality of at least substantially oval cross-sections between the lower front and upper smooth sloped profiles have a major axis width between 24 and 46 mm, and between the lower rear profile of the bridge zone and the bottom profile of the rear upper zone have a major axis width between 16 and 36 mm.

* * * * *